US008277181B2

(12) United States Patent
Hein et al.

(10) Patent No.: US 8,277,181 B2
(45) Date of Patent: Oct. 2, 2012

(54) FLUID PUMP AND METHOD FOR PRODUCING A FLUID PUMP

(75) Inventors: Bernd Hein, Baiersbronn/Schoenmuenzach (DE); Jerome Thiery, Strasbourg (FR); Christoph Heier, Iffezheim (DE); Claudius Muschelknautz, Buehl (DE)

(73) Assignee: Robert Bosch GmbH, Stuttgart (DE)

( * ) Notice: Subject to any disclaimer, the term of this patent is extended or adjusted under 35 U.S.C. 154(b) by 883 days.

(21) Appl. No.: 12/373,770

(22) PCT Filed: May 29, 2007

(86) PCT No.: PCT/EP2007/055180

§ 371 (c)(1), (2), (4) Date: Jan. 14, 2009

(87) PCT Pub. No.: WO2008/012130

PCT Pub. Date: Jan. 31, 2008

(65) Prior Publication Data

US 2009/0252607 A1 Oct. 8, 2009

(30) Foreign Application Priority Data

Jul. 25, 2006 (DE) ..... 10 2006 034 385

(51) Int. Cl.
*F04D 29/46* (2006.01)

(52) U.S. Cl. ..... 415/229

(58) Field of Classification Search ..... 415/204, 415/197, 200, 229; 417/423.8, 423.7, 356; 310/257; 29/288.02
See application file for complete search history.

(56) References Cited

U.S. PATENT DOCUMENTS

2008/0219839 A1 * 9/2008 Pfetzer et al. ..... 415/204

FOREIGN PATENT DOCUMENTS

| | | |
|---|---|---|
| DE | 199 34 382 | 2/2001 |
| DE | 10 2005 039 557 | 3/2007 |
| JP | 10-311293 | 11/1998 |
| WO | WO 01/38741 | 5/2001 |

* cited by examiner

*Primary Examiner* — Alexander Gilman
(74) *Attorney, Agent, or Firm* — Merchant & Gould P.C

(57) ABSTRACT

The invention relates to a fluid pump, in particular a liquid pump for a cooling and/or heating circuit of a motor vehicle, having a pump housing and having a rotationally fixed shaft, which is arranged in the pump housing, for an inner rotor which has an impeller wheel. According to the invention, it is proposed that the shaft is mounted at one side and, at its end remote from the bearing point, supports a bearing cap which engages at least partially around the shaft. The invention also relates to a method for producing a fluid pump of said type, in which method the shaft is fixed with its first end in a housing, in particular in a plastic housing, of the pump, the inner rotor of the pump is pushed onto the shaft and is secured axially by means of a bearing cap which is placed onto the shaft and is supported by the shaft.

7 Claims, 3 Drawing Sheets

FLUID PUMP AND METHOD FOR PRODUCING A FLUID PUMP

TECHNICAL FIELD

The invention relates to a fluid pump, in particular a liquid pump for a cooling and/or heating circuit of a motor vehicle, as well as to a method for producing such a fluid pump.

BACKGROUND

A liquid pump, in particular for the cooling/heating circuit of a motor vehicle, is known from the German patent DE 199 34 382 A1. Said pump has a claw pole stator and a rotor, which is separated from the stator by a pipe and is immersed in coolant, forming an impeller. The rotor of the liquid pump of the German patent DE 199 34 382 A1 is radially arranged inside the stator. A bearing journal of the rotor is rotatably connected to a fixed shaft at the axial ends of said journal and essentially encloses said shaft for its entire length. The length of the bearing journal is thereby at least large enough that the center of gravity of the rotor lies between the two axial ends of the bearing journal of the rotor. The shaft is anchored in a rotationally fixed manner at a first end in a recess of the base of the pump housing. Said shaft's second end is housed in the hub of a ribbed star, which is configured in one piece with the front section of the pump's housing and whose ribs run radially in the suction connection of the pump.

SUMMARY

The fluid pump according to the invention, which especially can be used as a fluid pump for a cooling and/or heating circuit of a motor vehicle, has a pump housing with a rotationally fixed shaft, which is arranged in the pump housing for an inner rotor which has an impeller wheel. The shaft is mounted, respectively fixed, in an advantageous manner only at one side, and, at its end remote from the bearing point, supports an end cap which engages at least partially around the shaft. Said end cap is from now on also denoted as a bearing cap.

This bearing cap, which serves as a retaining element, makes it possible in an advantageous manner for the mounting of the rotor and the resistance to dirt carried in the coolant, as for example foundry sand from the engine block, to be implemented through one single component part. By virtue of the fact that the bearing cap is merely supported by the rotationally fixed shaft and is not, for example, stabilized at the housing of the pump, an increase in the degree of efficiency of the pump is furthermore possible. This results from the fact that a cross-section constriction at the pump intake can be avoided due to a star-shaped fixing of a counter bearing on the pump housing, which, for example, can be implemented via connecting elements. With regard to the pump according to the invention, the different functions of mounting and dirt resistance, in particular resistance to the dirt carried away from the bearing point, can be implemented through one component part. This leads to a savings in cost and assembly of the pump according to the invention.

The configuration according to the invention of a fluid pump, in particular a liquid pump for the cooling and/or heating circuit of a motor vehicle, thus makes a simplified assembly process, respectively method for producing such a pump, possible. The method for producing such a pump allows for the shaft to be fixed with its first end in a plastic housing of the pump, so that the inner rotor can be pushed onto the shaft and subsequently secured axially by means of a bearing cap, which is placed onto the shaft and is supported by the shaft itself.

Advantageous modifications of the fluid pump according to the invention are possible by means of the characteristics stated in the dependent claims.

The bearing cap is advantageously mounted on the shaft in such a way that the inner rotor of the fluid pump is secured axially on the shaft. The bearing cap thus serves as an axial retaining element, which limits the axial relocatability of the rotor on the rotationally fixed shaft.

In an advantageous embodiment of the fluid pump according to the invention, the bearing cap is as a result configured as a hollow body, in particular as a metallic hollow body. This hollow body can, for example, have tabs, in particular tabs configured in one piece with the hollow body, on its side which faces the bearing point of the shaft. Said tabs make an operative connection of the bearing cap with the shaft possible.

For this purpose, at least one tab of the bearing cap can, for example, engage in a groove, which is inserted into the shaft, and axially fix the cap on the shaft.

In alternative embodiments of the pump according to the invention, the tabs can particularly be configured as metallic leaf springs so that the bearing cap can be pressed on, respectively attached to, the shaft when an appropriate pressing force is applied during elastic deformation of the bearing cap tabs.

The mounting process of the bearing cap can take place in a groove, in flutes or also directly on the shaft itself.

In alternative embodiments of the pump according to the invention, an additional washer, for example a retaining washer, can be inserted between the impeller wheel and the bearing cap which engages at least partially around the shaft.

The bearing cap, which is mounted on the second shaft end, advantageously has an essentially conical shape. The bearing cap particularly tapers in the direction of the suction orifice of the pump. The opening angle of the cone can thereby be advantageously correlated with the opening angle of the suction orifice of the pump. This allows for an effective redirecting, respectively a non-turbulent flow of the fluid flowing through the suction orifice against the impeller blades of the pump wheel.

The form of the bearing cap thus corresponds in an advantageous manner to a rotatable cone, respectively a frustum, the end of the bearing cap facing the suction orifice being flattened, respectively rounded off, in order to guarantee as much as possible an essentially laminar flow around the bearing cap.

The fluid pump according to the invention with its shaft mounted at one side, said shaft being provided with a cupped fixing element for the rotor, respectively the impeller wheel of the pump, at its end remote from the mounting, allows in an advantageous manner for the reliable mounting of the rotor, respectively impeller wheel, as well as for an efficient resistance to the dirt carried by the conveying fluid. This prevents in particular dirt particles from settling between the rotor and the shaft, which would lead to a considerable deterioration of the operating characteristics of the rotor of the fluid pump.

Additional advantages of the fluid pump according to the invention, respectively of the assembly process according to the invention for such a fluid pump, become apparent in the following description of an example of embodiment.

BRIEF DESCRIPTION OF THE DRAWINGS

An example of embodiment for the fluid pump according to the invention is depicted in the drawing. Said embodiment shall be described in detail in the following description. The figures of the drawing, their description as well as the claims contain numerous characteristics in combination. A specialist will also consider these characteristics individually and integrate them into further meaningful combinations. A specialist will also especially integrate characteristics from different embodiments into further meaningful combinations.

The following are shown.

DETAILED DESCRIPTION

Figure 1:
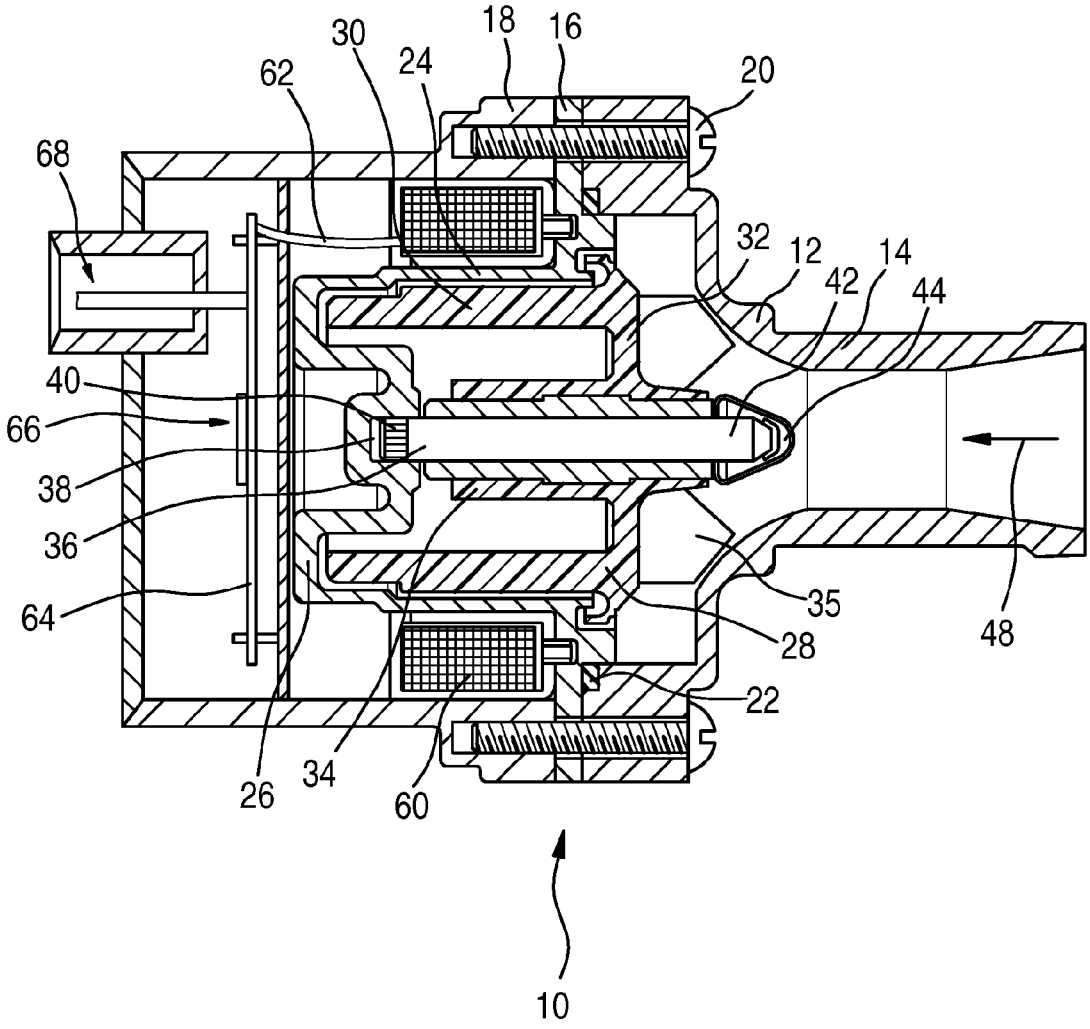
FIG. 1 is a first example of embodiment of a fluid pump according to the invention in a simplified longitudinal section depiction.

FIG. 1 shows a longitudinal section of a fluid pump according to the invention in a schematic general view.

The fluid pump according to the invention, which is shown in FIG. 1, has the embodiment of a cooling water pump, in particular a water pump for an internal combustion engine of a motor vehicle, the pump according to the invention being not limited to this embodiment. The pump 10 has a three parted housing, which consists of a housing front section 12 with a suction connection 14, which is configured at it, a partition 16 as well as a housing rear section 18.

The housing sections 12, 16, 18 are held together by screws 20 in the embodiment of FIG. 1. A gluing or welding of the housing sections is, however, also possible. The partition 16, which is essentially configured cup-shaped, is thereby inserted between the housing front section 12 and the housing rear section 18. A sealing ring 22 is tucked between the housing front section 12 and the partition 16. The partition 16 consists of a non-magnetic material and has a thin-walled section in the form of a pipe 24, which together with the base 26 forms a cup, wherein a rotor 28 is rotatably arranged.

The rotor 28 is manufactured from a synthetic resin bonded magnetic material, for example from a powdery magnetic material embedded in a synthetic resin bonded matrix or in a polymeric matrix, in particular in one piece, for example by injection molding. The rotor has an outer cylinder 30, which follows the progression of the pipe 24 of the cup-shaped partition 16 with only a slight amount of clearance. The outer cylinder 30 is closed at its end facing the suction connection 14 by a flange 32. The flange 32 supports a plurality of impellers, respectively blades, and thereby constitutes an impeller or impeller wheel 35 of the pump, which is configured in one piece with the rotor in the example of embodiment of FIG. 1.

A bearing journal 34, which with the rotor flange 32 constitutes one piece, extends through the inside of the cylinder 30 of the rotor 28. The bearing journal 34 and thus the rotor 28 is rotatably arranged on a rotationally fixed shaft 36 and essentially encloses said shaft 38 for its entire length.

The shaft 36 is anchored in a rotationally fixed manner at a first end in a recess 38 of the base 26 of the pump housing. For this purpose, the shaft 36 of the example of embodiment is according to FIG. 1 provided with a knurl 40, with which the, for example, metallic shaft is pressed into the recess 38 of the plastic base 26. Other possibilities known to the specialist are likewise possible for fixing the first shaft end in the pump housing or on said housing.

At its second end 42 remote from the bearing point 38, the shaft 36 supports a bearing cap 44, which engages at least partially around the shaft and is attached on it. The bearing journal 34 of the rotor 28 is thus secured between the recess 38, which represents a first bearing point of the shaft, and the bearing cap 44.

The bearing cap 44 has essentially a conical form, which particularly tapers in the direction of the suction orifice of the suction connection 14.

The opening angle of the cone of the bearing cap 44 corresponds in an advantageous manner with the opening angle of the suction orifice of the pump. The bearing cap 44 is advantageously configured to such an extent, that the mounting of the rotor of the pump as well as the resistance to dirt, for example the dirt carried in the coolant of an internal combustion engine, can therefore be ensured in one single component part. The conical configuration of the bearing cap, whose shape, for example, lies between the shape of a rotatable cone and that of a frustum, furthermore increases the degree of efficiency of the pump because turbulences can be avoided by the shape of the bearing cap and in particular by not having to attach such a bearing cap using housing connecting elements. Because the bearing cap is only supported by the shaft itself, a cross-section constriction at the pump due to connecting elements, which is known from the technical field, can under no circumstances occur. Moreover, the configuration of the bearing cap, which is rounded off and frustum-like, leads to an effective repelling of the dirt carried in the coolant away from the bearing point. The shape of the bearing cap, which essentially carries forward the wake velocity profile of the hub of the rotor, in combination with the configuration of the suction orifice allows for the suppression of fluid turbulences in the region of the impeller wheel of the pump.

Figure 2:
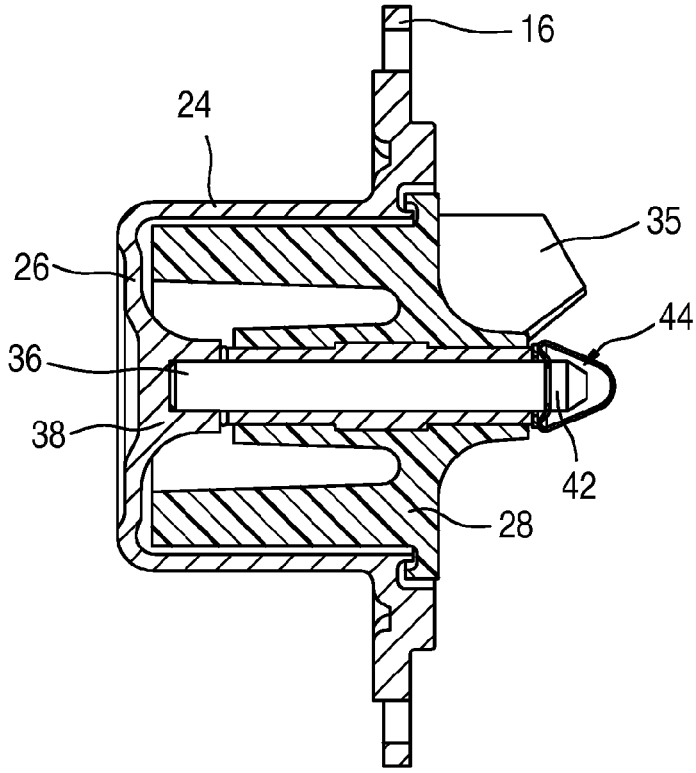
FIG. 2 is a detailed depiction of an alternative embodiment of a fluid pump according to the invention in the region of the rotor of the pump.

FIG. 2 shows an alternative embodiment of a fluid pump for the clarification of the detailed depiction of the rotor, which is secured on the shaft. Functionally analog component parts are thereby designated with the same reference numerals as in FIG. 1. The shaft 36 is fixed at one side in a recess 38, which serves as a bearing point, of the cup-shaped base 28 of the partition 16. In the example of embodiment of FIG. 2, the shaft is merely pressed, respectively glued, into the recess without any special knurling. A rotor 28 from a synthetic resin bonded magnetic material is placed onto the shaft. An impeller wheel 35 with a plurality of impeller blades is configured in one piece with the rotor. Only a single impeller blade is, however, depicted in the diagram of FIG. 2. The rotor 28, which has been placed on the shaft 36 and simultaneously serves as an impeller wheel 35 for the fluid to be conveyed, is secured axially by means of a bearing cap 44, which is pressed onto the shaft 36. In so doing, the bearing cap 44 engages the end 42 of the shaft 36 remote from the bearing point 38.

Figure 3:
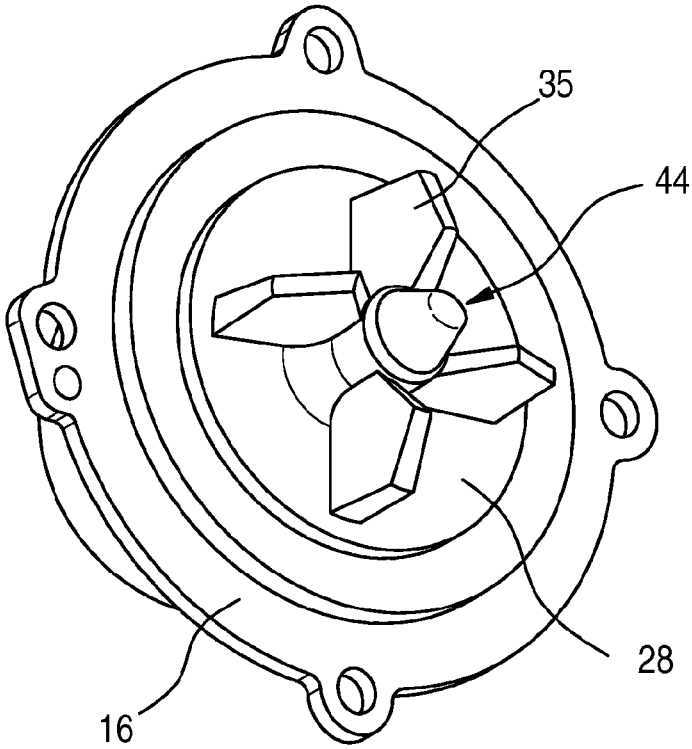
FIG. 3 is a perspective top view of the impeller wheel of the fluid pump with a mounted bearing cap.

In a perspective depiction, FIG. 3 shows the rotor 28, with which the impeller wheel 35 with the impeller blades is constructed as one piece, inserted into the cup-shaped partition 16. The rotor 28 is secured axially by means of the bearing cap 44 according to the invention on the rotationally fixed shaft 36.

Figure 4:
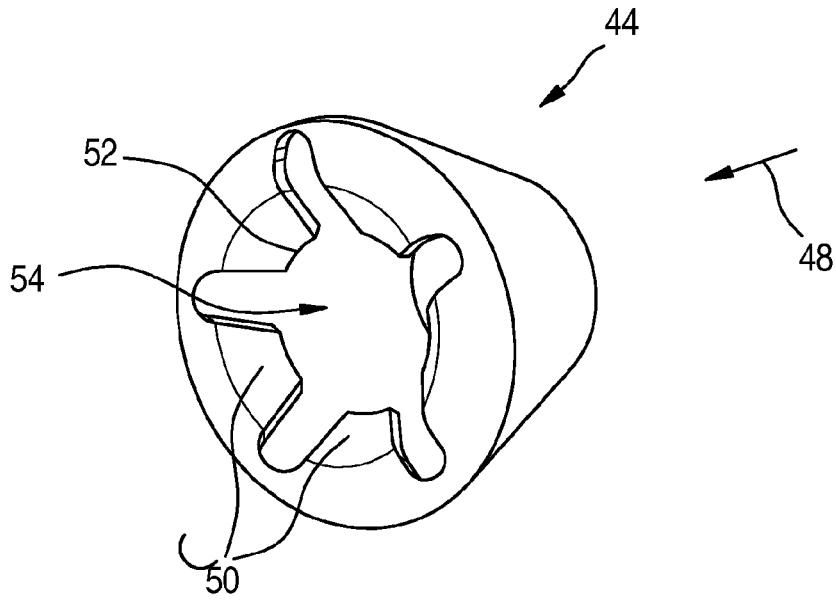
FIG. 4 is an example of embodiment of a bearing cap.

FIG. 4 shows an example of embodiment for a bearing cap 44, whose depiction is not drawn to scale. This bearing cap can, for example, be obtained by deep drawing, bending or variously configuring a metallic material, for example sheet metal. The bearing cap 44 is configured as a hollow body; and in so doing, the cap has a plurality of bent tabs 50, whose free ends 52 are bent in the direction of the interior space 54, at its end remote from the inflow direction 48. The tabs 50, which are annularly arranged, thus define an opening 56 of the bearing cap 44, which is configured on the side of the cap facing away from the inflow direction 48. The free end of the shaft 42 can be inserted into this opening 56 of the bearing cap 44.

The diameter of this opening 56 is advantageously less than the diameter of the shaft, upon which the bearing cap is to be placed and secured, by a small amount.

Figure 5:
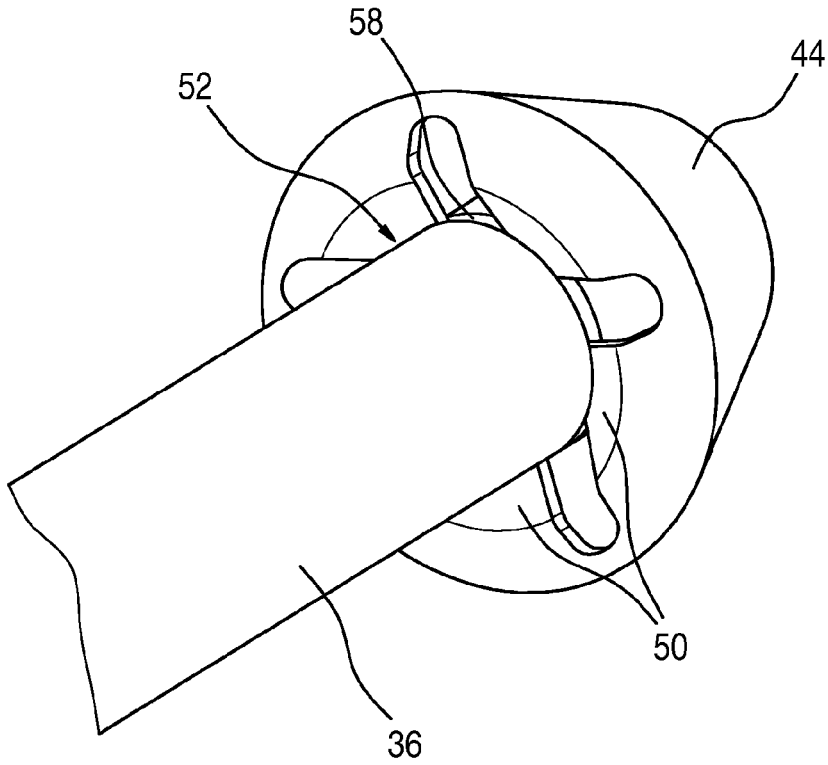
FIG. 5 is a bearing cap, which is mounted on and fixed to the free end of the shaft.

In a detailed depiction, FIG. 5 shows bearing cap 44, which has been placed on a shaft 36.

When pressing the shaft 36 into the interior space 54 of the bearing cap 44, the tabs 50 can be elastically pushed back in the manner of leaf springs, so that they push with a corresponding counter force on the shaft 36 and thereby reliably secure the bearing cap 44 on the shaft 36.

In the example of embodiment of FIG. 5, the shaft 36 is provided with a groove 58, which runs circumferentially and wherein the free ends 52 of the tabs 50 can engage. In this way, a particularly reliable securing of the bearing cap 44 on the second end of the shaft 42 can be guaranteed.

In alternative embodiments, provision can still yet be made for an additional retaining washer between the bearing cap 44 and the impeller wheel of the rotor.

The fluid pump according to the invention can be assembled in a simple manner because the shaft merely has to be fixed at its first end in a plastic housing of the pump, for example in the cup-shaped base 26 of the partition 16. The rotor 28 can then be pushed onto the shaft and be secured axially by means of the bearing cap 44, which is placed onto the shaft and is supported by the shaft.

The fluid pump according to the invention is not limited to the embodiments described in the figures.

In particular the fluid pump is not limited to a metallic bearing cap. Bearing caps made of plastic or a natural, for example elastic, material are likewise conceivable.

The fluid pump according to the invention is furthermore not limited to the methods of anchoring the shaft in the pump housing, respectively in the bearing cap, which are described here. Additional methods of anchoring, which are known to the specialist, are likewise possible in the fluid pump according to the invention.

A metallic bearing cap can, for example, be produced from a stamped and/or deep drawn sheet metal.

The bearing cap according to the invention, which is supported by the shaft, consequently constitutes a counter bearing of the impeller wheel of the fluid pump according to the invention.

The fluid pump according to the invention is furthermore not limited to the embodiment of the canned motor pump, which has been described.

The electric motor, which drives the fluid pump in the example of embodiment of FIG. 1, is configured as a so-called canned motor, wherein the rotor revolving in the conveying fluid is separated from the fixed stator, which runs radially around the rotor, by a thin partition. The can 24 is constructed as one piece with the partition 16 and the base 2 in the example of embodiment of FIG. 1. The solenoid 60 of the stator of the electric motor is furthermore anchored to the partition 16. The solenoid 60 is connected via electrical connection means 62 to a printed circuit board 64, whereupon the power electronics 66 for the actuation of the pump are arranged. Such a pump can be connected to, for example, an electrical system of a motor vehicle via an appropriate connecting element 68 in order to serve as a booster pump for the coolant in a cooling circuit, respectively heating circuit, of the motor vehicle. In an advantageous manner, the stator, as described in the German patent DE 199 34 382 A1, can be configured as a claw pole stator. This construction form makes it possible with a simple winding in the form of a solenoid 60 to implement a high number of pole pairs for driving the rotor 28.

In order to increase the drive capacity of the pump, a plurality of stators can be assembled axially in a row.

The invention claimed is:

1. A fluid pump, in particular a liquid pump, for at least one of a cooling and a heating circuit of a motor vehicle, comprising:

a rotationally fixed shaft arranged in a pump housing for an inner rotor that has an impeller wheel, wherein a shaft first end is mounted in the pump housing, and at an opposite end remote from a bearing point supports a bearing cap that engages at least partially around the shaft, the bearing cap having a hollow metallic body defining an interior space and having a plurality of annularly spaced tabs with free ends bent in a direction towards the interior space of the hollow body.

2. The fluid pump of claim 1, wherein the bearing cap is mounted on the shaft to axially secure the inner rotor on the shaft.

3. The fluid pump of claim 1, wherein at least one of the plurality of tabs engages into a groove of the shaft.

4. The fluid pump of claim 1, wherein the bearing cap has an essentially conical shape.

5. The fluid pump according of claim 1, wherein the bearing cap tapers in a direction of a suction orifice of the fluid pump.

6. The fluid pump according to claim 5, wherein an opening angle of a cone of the bearing cap is correlated with an opening angle of the suction orifice of the pump.

7. A method of producing a fluid pump, in particular a liquid pump for at least one of a cooling and a heating circuit of a motor vehicle, the pump comprising a rotationally fixed shaft arranged in a pump housing for an inner rotor that has an impeller wheel, the method comprising:

fixing a shaft first end in a housing of the pump, in particular in a plastic housing;

pushing the inner rotor of the pump onto the shaft; and axially securing the shaft with a bearing cap that is placed onto and supported by the shaft wherein the bearing cap is a hollow metallic body defining an interior space and has a plurality of annularly spaced tabs with free ends bent in a direction towards the interior space of the hollow body.

* * * * *